US005581332A

United States Patent [19]

Frelier et al.

[11] Patent Number: 5,581,332

[45] Date of Patent: Dec. 3, 1996

[54] POWER LIFT DEVICE FOR DOCUMENT FEEDER

[75] Inventors: Calvin A. Frelier, Penfield; Dirk Climenhaga, Albion; Gene F. Gordon, Rochester, all of N.Y.

[73] Assignee: Eastman Kodak Company, Rochester, N.Y.

[21] Appl. No.: 382,716

[22] Filed: Feb. 2, 1995

[51] Int. Cl.[6] ..... G03G 21/00

[52] U.S. Cl. ..... 355/231

[58] Field of Search ..... 355/231, 75, 200, 355/318, 320

[56] References Cited

U.S. PATENT DOCUMENTS

| | | | |
|---|---|---|---|
| 3,467,469 | 9/1969 | Hastings et al. | 355/67 |
| 3,724,949 | 4/1973 | Kanno et al. | 355/75 |
| 3,944,365 | 3/1976 | Van Buskirk | 355/75 |
| 4,439,036 | 3/1984 | Davis et al. | 355/75 |
| 4,449,811 | 5/1984 | Betron et al. | 355/231 |
| 4,548,491 | 10/1985 | Eiland | 355/200 |
| 5,126,787 | 6/1992 | Irie et al. | 355/75 |

FOREIGN PATENT DOCUMENTS

| | | | |
|---|---|---|---|
| 56-027173 | 3/1981 | Japan | 355/231 |
| 02251974 | 10/1990 | Japan | 355/231 |

*Primary Examiner*—Robert Beatty
*Attorney, Agent, or Firm*—Lawrence P. Kessler

[57] ABSTRACT

A reproduction apparatus including an exposure platen upon which an original document sheet is placed to facilitate obtaining an image for effecting copying of such document sheet. The reproduction apparatus includes a feeder for transporting original document sheets to, and from, the exposure platen. The feeder is mounted on the reproduction apparatus for pivotal movement about an axis adjacent to an edge of the exposure platen. A power lift device is connected to the feeder for selectively automatically pivoting the feeder about the axis to enable ready operator access to the exposure platen.

10 Claims, 5 Drawing Sheets

POWER LIFT DEVICE FOR DOCUMENT FEEDER

BACKGROUND OF THE INVENTION

The present invention relates in general to document feeders for reproduction apparatus, and more particularly to a power lift device for automatically raising and lowering a document feeder of a reproduction apparatus.

Reproduction apparatus available today, such as copier/duplicators or printers and the like, have become more complex and versatile in operation. They are extremely sophisticated and can accomplish a wide range of reproduction routines. In typical commercial electrostatographic reproduction apparatus, a latent image charge pattern is formed on a uniformly charged dielectric member. Pigmented marking particles are attracted to the latent image charge pattern to develop such image on the dielectric member. A receiver member (for example, a cut sheet of plain bond paper) is then brought into contact with the dielectric member. An electric field, such as provided by an electrically biased roller or corona charger, is applied so as to effect transfer of the marking particle developed image to the receiver member from the dielectric member. After transfer, the receiver member bearing the transferred image is separated from the dielectric member and transported away from the dielectric member to a fuser assembly at a downstream location. At the fuser assembly, the image is fixed to the receiver member by heat and/or pressure to form a permanent reproduction thereon.

In order to increase the productivity and ease of use of such electrostatographic reproduction apparatus, it has been common practice to provide such apparatus with automatic document handlers. Early document handlers accepted a document sheet set stack and removed individual sheets from the stack one at a time. The removed document sheet was delivered to the exposure platen of the reproduction apparatus, where the desired number of copies of such document sheet were made, and then returned to the stack. Such copy sequence necessitated the use of an auxiliary device, such as a sorter for example, in conjunction with the reproduction apparatus to provide collated reproduction sets.

More recently, automatic document handlers, typically referred to as recirculating document feeders, have been developed which eliminate the need for sorter devices. Recirculating document feeders, such as shown for example in U.S. Pat. No. 4,169,674 (issued Oct. 2, 1979, in the name of Russel) deliver document sheets seriatem from a document sheet set stack to the exposure platen of the reproduction apparatus and return the sheets to the document stack in order. Typically, at the exposure platen only one copy of each document sheet is made for each circulation of the document sheets set stack. The desired number of copies is obtained by recirculating the document sheet set stack a number of times corresponding to the desired number of copies. By such copy sequence, the copy sheet output corresponding to the document sheet set stack is received at the output of the reproduction apparatus in collated order.

While document feeders, of either type, have proven very popular in that they enhance productivity and increase the ease of use of the reproduction apparatus, they require complex construction to reliably handle the document sheets in a manner which will prevent damage to the sheets during transport. Further, the document feeders are cumbersome, and require intricate counterbalance mechanisms to enable them to be manually raised (and lowered) for operator access to the exposure platen of the associated reproduction apparatus. In certain instances, because the document feeders require manual raising and lowering, physically challenged individuals are not able to gain access to the reproduction apparatus exposure platen because of their physical limitations and the construction of the document feeders. Particularly, such individuals may not be able to raise and/or lower the document feeder due to lack of strength or inability to reach to the full extent necessary for raising and lowering the feeder (such as when confined to a wheel chair).

SUMMARY OF THE INVENTION

In view of the foregoing discussion, this invention is directed to a power lift device for a document feeder of a reproduction apparatus, whereby the document feeder is automatically raised and lowered for ready access to the exposure platen of the reproduction apparatus, even by the physically challenged. The reproduction apparatus includes an exposure platen upon which an original document sheet is placed to facilitate obtaining an image thereof for effecting copying of such document sheet. The feeder for transporting original document sheets to, and from, the exposure platen, is mounted on the reproduction apparatus for pivotal movement about an axis adjacent to an edge of the exposure platen. A power lift device is connected to the feeder for selectively automatically pivoting the feeder about the axis to enable ready operator access to the exposure platen.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
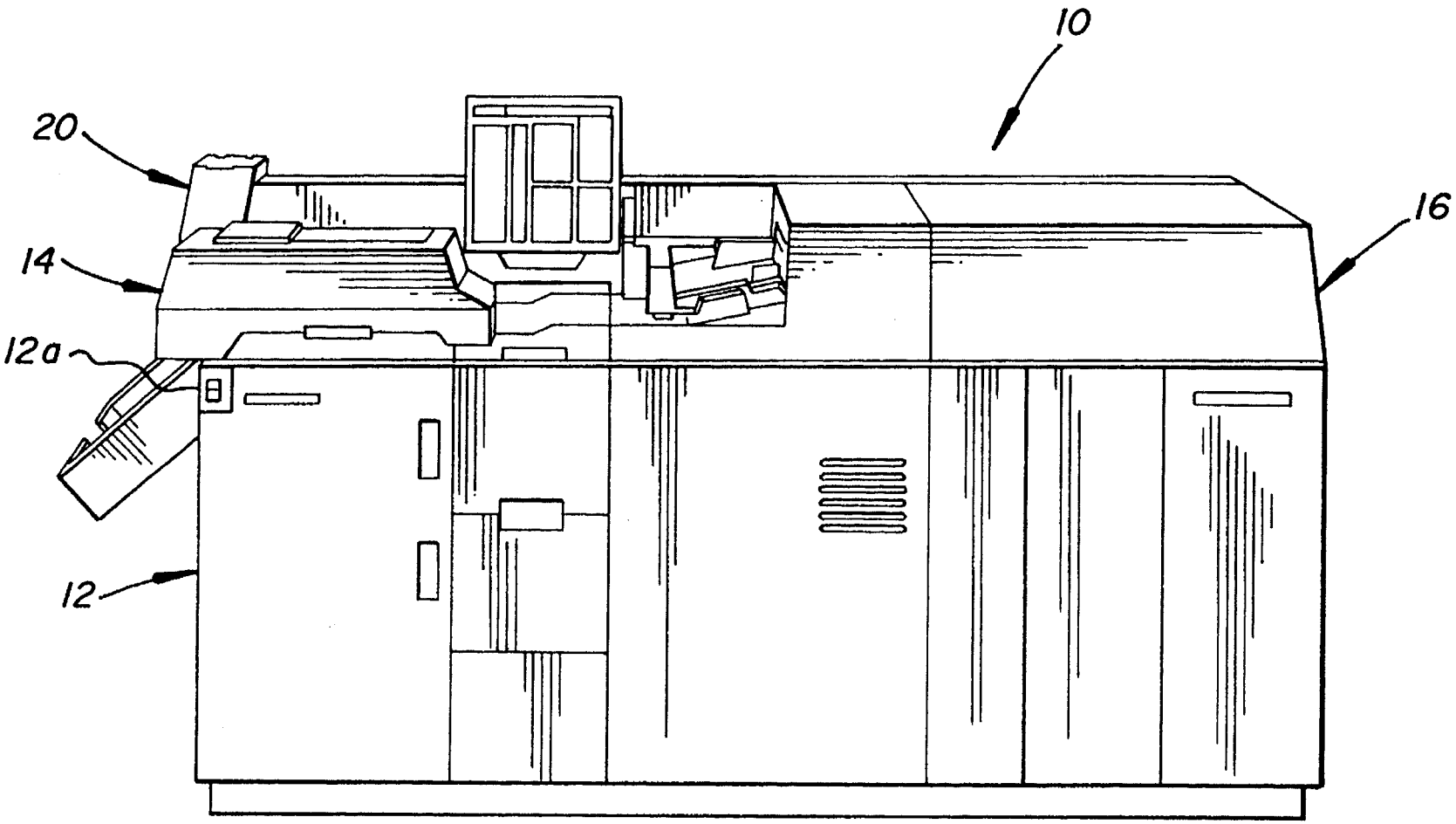
FIG. 1 is a front elevational view of a typical electrostatographic reproduction apparatus, including a recirculating document feeder and a power lift device for such document feeder, according to this invention.
Figure 2:
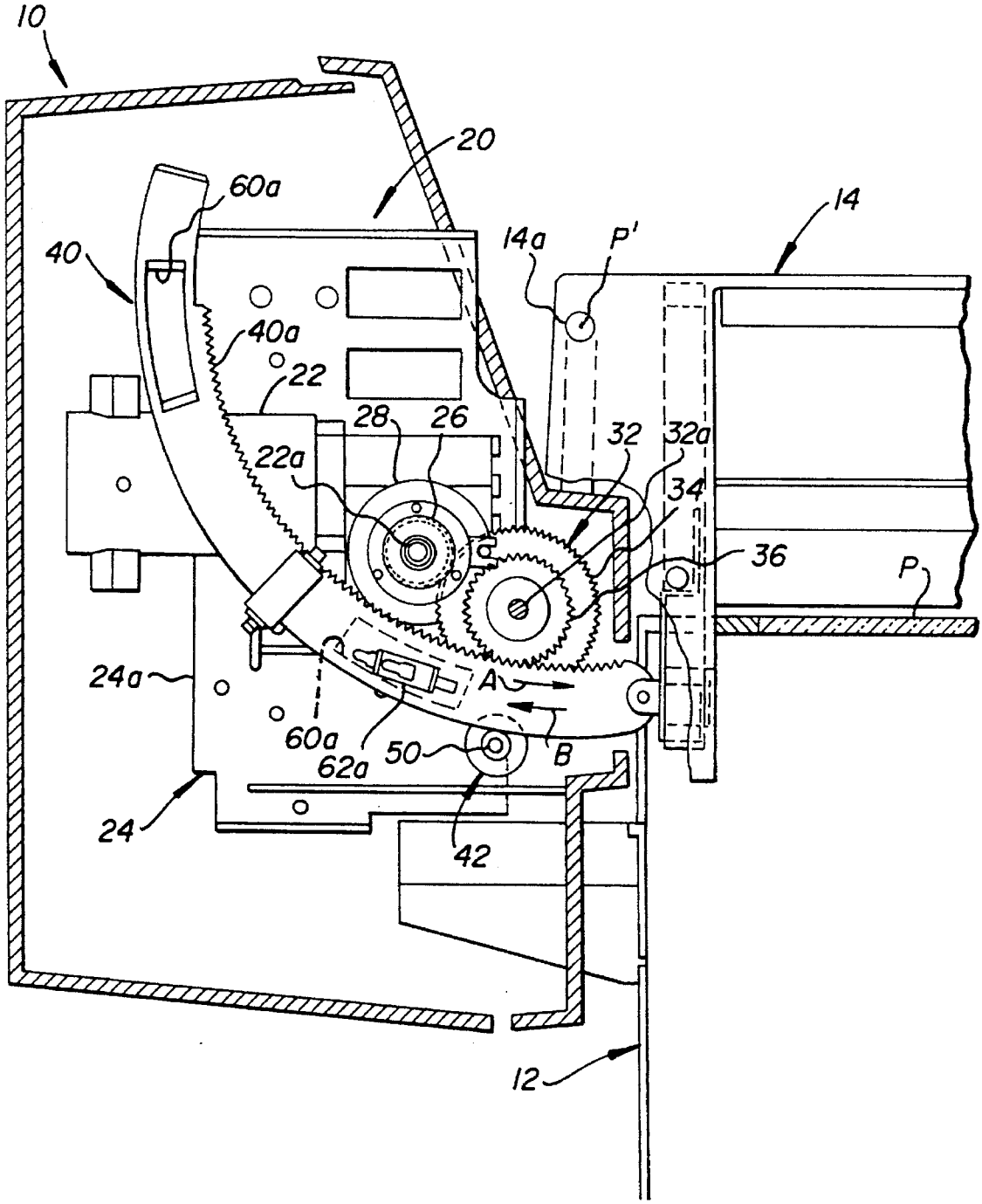
FIG. 2 is a side elevational view, on an enlarged scale, partly in cross-section, of a portion of the recirculating document feeder, in the operative position relative to the platen of the electrostatographic reproduction apparatus, and the document feeder power lift device according to this invention, with portions broken away to facilitate viewing.
Figure 3:
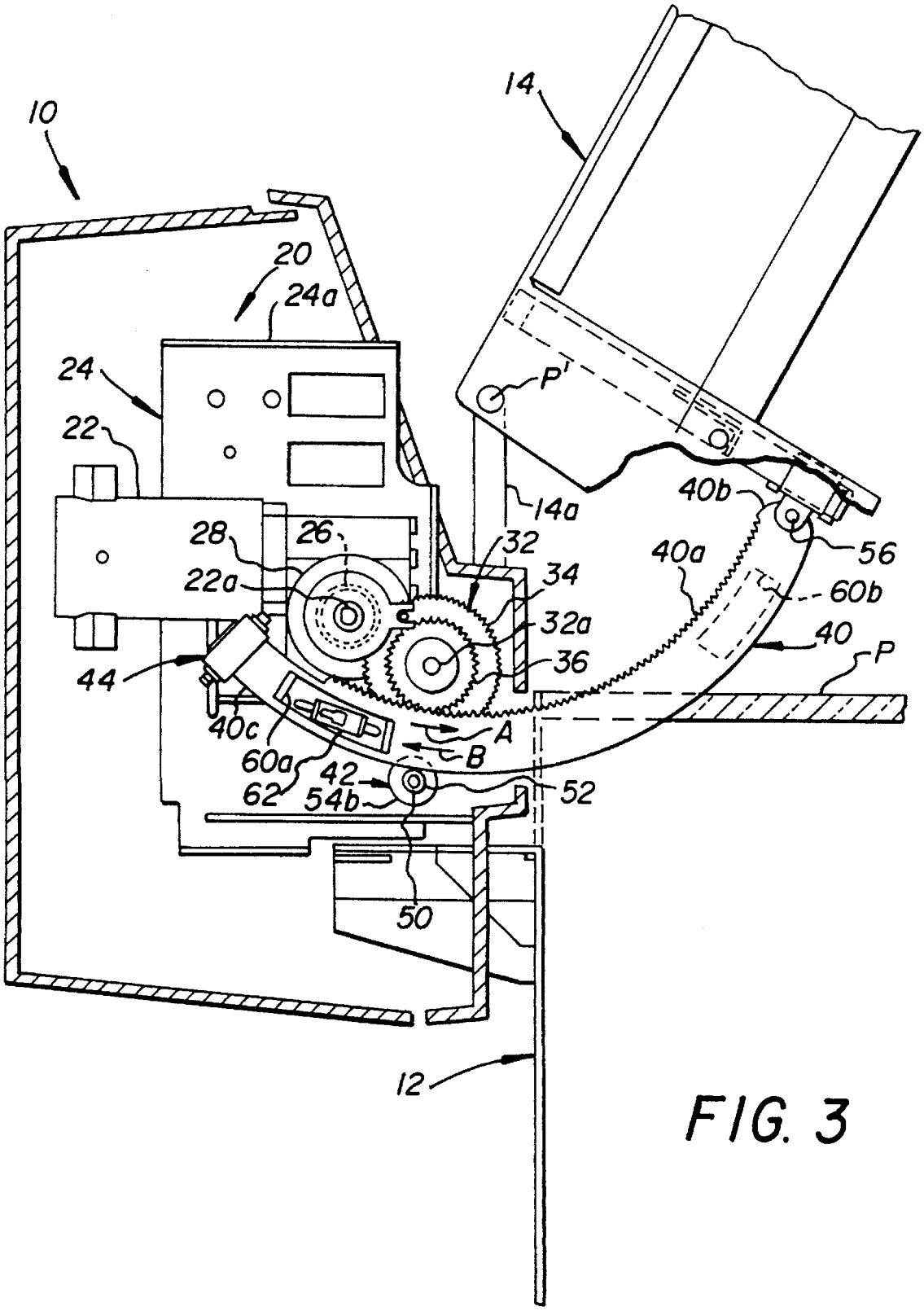
FIG. 3 is a side elevational view, on an enlarged scale, partly in cross-section, of a portion of the recirculating document feeder and the document feeder power lift device, similar to FIG. 2, with the document feeder in the remote position relative to the platen of the electrostatographic reproduction apparatus, with portions broken away to facilitate viewing.
Figure 4:
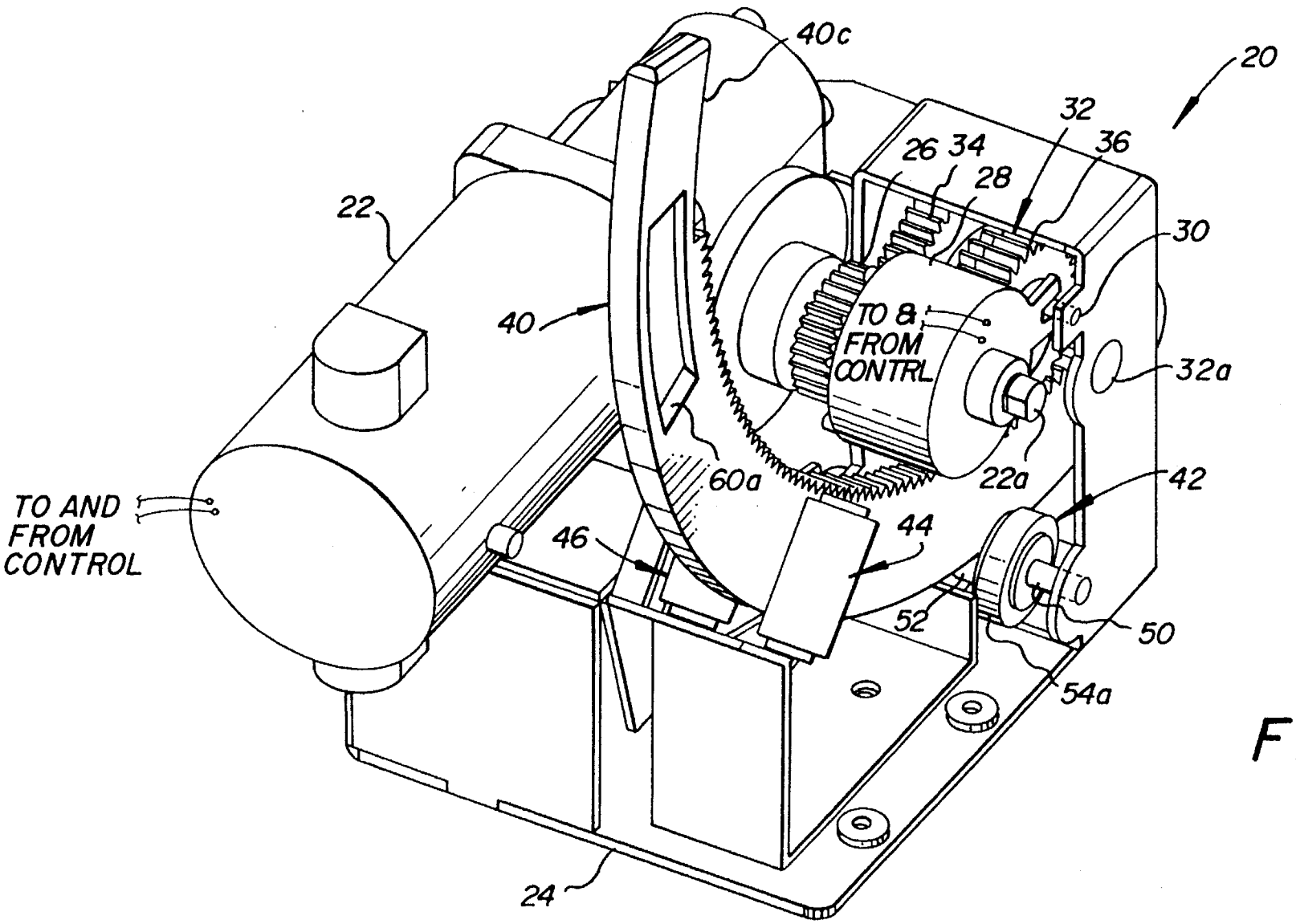
FIG. 4 is a view, in perspective from the right rear, of the document feeder power lift device according to this invention, with portions broken away to facilitate viewing.
Figure 5:
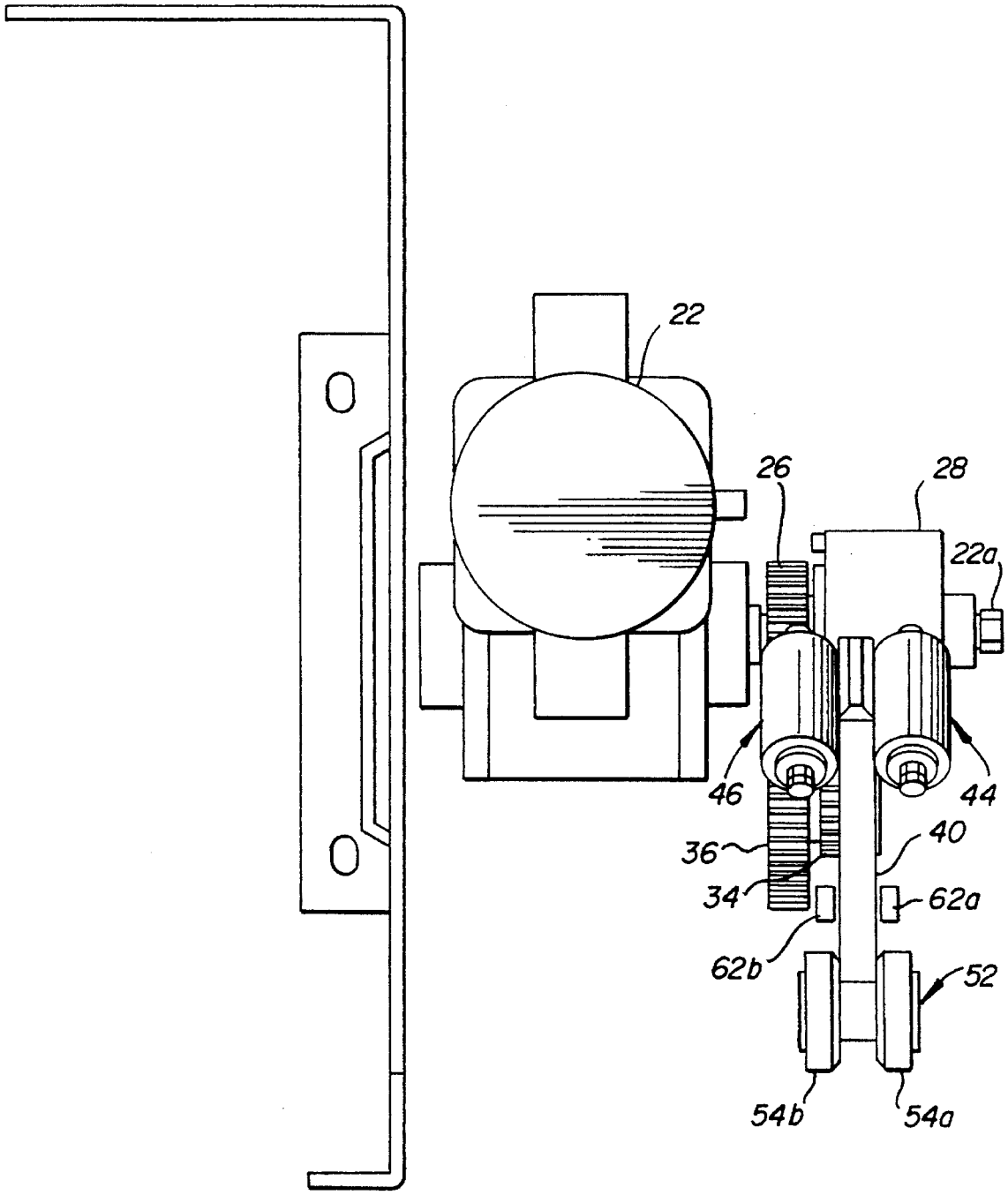
FIG. 5 is a rear elevational view, partly in cross-section, of the document feeder power lift device according to this invention, with portions broken away to facilitate viewing.

Referring now to the accompanying drawings, a typical reproduction apparatus, designated by the numeral 10, is shown in FIG. 1. The reproduction apparatus 10 includes an electrostatographic marking engine 12, a recirculating document feeder 14, and an output accessory 16, such as a finisher or sorter for example. The document feeder 14, for example of the type shown and described in the aforementioned U.S. Pat. No. 4,169,674, serves to recirculate original document sheets between a sheet stack and the platen P (see FIGS. 2 and 3) of the marking engine 12 to enable images of the respective document sheets to be captured for reproduction of copies thereof. The recirculating document feeder 14 is mounted on a pivot assembly 14*a* supported by the housing of the marking engine 12 adjacent an edge of the platen P. As such, the recirculating document feeder may be moved about the pivot axis P' to an operative position with respect to the platen P (see FIG. 2) of the reproduction apparatus marking engine 12, or to a remote position with respect to the platen (see FIG. 3) to provide ready access thereto.

As will be appreciated from the discussion above, the internal construction of a typical document feeder, in order to reliably handle the document sheets in a manner which will prevent damage to the sheets during transport, is of a complex nature which makes the feeder relatively heavy. As such, the typical document feeder may require an intricate counterbalance mechanism to enable it to be manually raised (and lowered) for operator access to the exposure platen of the associated reproduction apparatus. However, even with suitable counterbalance mechanisms, physically challenged individuals may not able to manually gain access to the reproduction apparatus exposure platen because of their physical limitations. Particularly, they may not be able to raise the document feeder due to lack of strength or inability to reach to the full extent necessary for raising and lowering the feeder (such as when any of such individuals are confined to a wheel chair).

This invention is directed to a power lift device, designated generally in the drawings by the numeral 20, for automatically raising and/or lowering a typical document feeder, such as the recirculating document feeder 14, for a reproduction apparatus, such as the electostatographic marking engine 12 of the reproduction apparatus 10. Of course it is understood that the document feeder power lift device 20 according to this invention is suitable for use with many other well known document feeders and reproduction apparatus.

The power lift device 20 (as best seen in FIGS. 2–5), according to this invention, includes a motor 22 supported in a frame 24 having a side plate 24*a* attached to the side of the housing of the marking engine 12 of the reproduction apparatus 10. The motor 22, which may be of any suitable type, is shown in the illustrated example as a reversible D.C. motor having a transverse output shaft 22*a* (for example a Bodine motor Model 4694). A pinion 26 is mounted on an output shaft (not shown) of a clutch 28 for free rotation relative thereto. Rotational power is selectively transmitted from the output shaft 22*a* of the motor to the pinion, for rotation therewith, by the clutch 28. The clutch 28, which may be of any suitable well known type, is shown in the illustrated example as an electrically energized friction clutch (for example an Inertia Dyn Inc. SL17).

The electrically actuated friction clutch 28 is mounted on the output shaft 22*a* and is staked to the frame 24 by the pin 30 (see FIG. 4) to prevent rotation of the clutch with the output shaft. The output shaft 22*a* is connected to the input of the clutch 28, while the output from the clutch is connected to the pinion 26. Accordingly, with the motor 22 activated, the clutch 28 may be selectively energized to couple the output shaft 22*a* to the pinion 26 such that the pinion rotates with the output shaft. The control for activating the motor 22 and energizing the clutch 28 may be readily accessed by a push button type control panel 12*a* mounted on the front of the housing of the marking engine 12. Operator pushing of appropriate buttons will send corresponding appropriate signals, for example through the control (not shown) for the reproduction apparatus 10, to the motor 22 and the clutch 28 in order to automatically raise and/or lower the document feeder 14 as desired, in the manner to be more fully explained below.

The pinion 26 is operatively associated with an arcuate lifting member 40 through a gear cluster 32. The gear cluster 32, mounted on a shaft 32*a* supported by the frame 24, includes a first gear 34 and a second gear 36. The first gear 34 is in mesh with the pinion 26, while the second gear 36 is in mesh with a gear rack 40*a* of the arcuate lifting member 40. Therefore, when the pinion 26 is selectively rotated (by the motor 22 through the clutch 28) to rotate the first gear 34, the second gear 36 will cause the lifting member 40 to exhibit a corresponding movement. That is to say, when viewing the power lift device 20 as in the direction of FIGS. 2 and 3, when the pinion 26 is rotated in a clockwise direction, the lifting member 40 will move in the direction of arrow A; conversely, when the pinion 26 is rotated in a counterclockwise direction, the lifting member 40 will move in the direction of arrow B.

The arcuate lifting member 40 is connected at an outboard end 40*b*, in any suitable manner, to the frame of the document feeder 14, for example by the pin 56. The arcuate shape for the lifting member 40 is selected such that the longitudinal axis of the lifting member describes a segment of an arc having a radius substantially equal to the distance between the axis P' of the pivot assembly 14*a* to the axis of the pin 56. The movement of the arcuate lifting member 40 is relegated to a predetermined path, describing an arc having a radius substantially equal to the distance from the longitudinal axis of the lifting member to the axis P' of the pivot assembly 14*a*, with the axis of the pin 56 being located so as to lie in the predetermined path of movement for the lifting member 40. Accordingly, the longitudinal axis of the lifting member and such predetermined path are coincident. As such, the movement of the lifting member 40 translates into the automatic pivoting of the document feeder 14 about the pivot axis 14*a* to locate the document feeder in operative association with the platen P of the marking engine 12, or in a position remote from the platen for ready access thereto. It should be pointed out that the operative position referred to with respect to FIG. 2, may in fact be a position where the document feeder is spaced slightly above the platen P, with lowering of the document feeder for the last few degrees of rotation, or raising of the document feeder for the first few degrees of rotation, being accomplished manually. This has the advantage of preventing pinching of the operator's hand between the platen and the document positioner.

The predetermined path for the arcuate lifting member 40 is defined by confining the lifting member for movement between the second gear 36 and a roller assembly 42, and between a pair of rollers 44, 46. The roller assembly 42 includes a support shaft 50 and a spoll type roller 52. The support shaft 50 is mounted in the frame 24. The spool roller 52 is mounted on the shaft 50 such that the roller 52 supports the lifting member 40, while end portions 54*a*, 54*b* of the spool roller confine the lifting member against movement in the direction parallel to the axis of the shaft 50. The pair of rollers 44,46 are also supported in the frame 24. Such rollers are located such that their respective peripheral surfaces engage the lifting member 40 and substantially prevent the lifting member 40 from movement in the direction perpendicular to the predetermined path and parallel to the axis of rotation of the second gear 36.

The lifting member 40 has a pair of recesses 60*a*, 60*b* located near the ends 40*c*, 40*b*, respectively, of the lifting member on opposite sides thereof. The pair of recesses cooperate respectively with a pair of switches 62*a*, 62*b* attached to the frame 24. The switch 62*b*, cooperating with the recess 60*a*, is shown in FIGS. 2–5 of the drawings, while the switch 62*a*, being attached to the frame so as to be located on the opposite side of the lifting member 40 to cooperate with the recess 60*b*, is shown only in FIG. 5. The switches 62*a*, 62*b* respectively detect when the lifting member 40 reaches the limit of travel (i.e., the operative position of FIG. 2 and the remote position of FIG. 3). When the switch 62*b* cooperating with the recess 60*b* is made, such switch will complete the circuit for the motor 22. This enables the motor to be activated to effect lifting of the document feeder 14, as described above, when the appropriate button of the control panel 12*a* is pushed. On the other hand, when the switch 62*a* cooperating with the recess 60*a* is made, such switch will complete the circuit for the motor 22 and reverses the direction of rotation of the motor 22. Accordingly, when the appropriate button of the control panel 12*a* is pushed, the motor 22 is activated to effect lowering of the document feeder 14, as described above.

It should be pointed out that the deactivation of the motor 22 and de-energization of the clutch 28 stop the drive for the lifting member 40, and holds the lifting member in the appropriate position. This will retain the location of the document feeder 14 relative to the platen P of the marking engine until it is desired to move the document feeder, and movement of the lifting member 40 in the opposite direction is initiated. However, due to the particular above described arrangement of the friction clutch 28 on the shaft 22*a*, it is possible to over-ride the power lift device 20 and, if desired, manually raise and lower the document feeder 14 without any appreciable increased drag determined by the user.

The invention has been described in detail with particular reference to preferred embodiment thereof, but it will be understood that variations and modifications can be effected within the spirit and scope of the invention as set forth in the claims.

What is claimed is:

1. A reproduction apparatus including an exposure platen upon which an original document sheet is placed to facilitate obtaining an image thereof for effecting copying of such document sheet, said reproduction apparatus comprising:

a feeder for transporting original document sheets to, and from, said exposure platen, said feeder being mounted on said electrostatographic reproduction apparatus for pivotal movement about an axis adjacent to an edge of said exposure platen; and a power lift device including a lifting member connected to said feeder, means for defining an arcuate path for said lifting member, about an axis coincident with said feeder pivot axis, means for moving said lifting member along said arcuate path, and control means for selectively activating said moving means to move said lifting member in a first direction along said arcuate path or a second direction along said arcuate path, substantially opposite to said first direction for selectively automatically pivoting said feeder about said feeder pivot axis to enable ready operator access to said exposure platen.

2. The reproduction apparatus according to claim 1 wherein said lifting member is a rack, and wherein said means for moving said rack includes a reversible motor having an output drive shaft, and a gear train connecting said output drive shaft to said rack.

3. The reproduction apparatus according to claim 2 wherein said rack is supported for movement along said arcuate path in roller assemblies.

4. The reproduction apparatus according to claim 3 wherein said control means includes limit switches, contacting said rack, adapted to be actuated at the respective ends of travel of said lifting member in said arcuate path.

5. The reproduction apparatus according to claim 4 wherein said rack is of an arcuate shape, the longitudinal axis of which is coincident with said arcuate path.

6. The reproduction apparatus according to claim 5 wherein said feeder recirculates original document sheets seriatim from a stack of original document sheets to said platen and back to such stack.

7. In a reproduction apparatus including a feeder for transporting original document sheets seriatim to, and from, an exposure platen upon which an original document sheet is located for obtaining an image thereof, said feeder being mounted on said reproduction apparatus for pivotal movement about an axis spaced from and parallel to an edge of said exposure platen, and a power lift device for selectively automatically pivoting said feeder about said pivot axis to enable ready operator access to said exposure platen, said power lift device comprising:

a lifting member;

means for defining an arcuate path for said lifting member, said arcuate path being taken about said feeder pivot axis so as to correspond to the desired movement of said feeder relative to said exposure platen, and wherein said lifting member is of an arcuate shape, the longitudinal axis of which is coincident with said arcuate path, and is supported for movement along said predetermined arcuate path in roller assemblies;

a motor having an output shaft, and means for operatively coupling said output shaft to said lifting member to move said lifting member when said motor is activated; and control means for selectively activating said motor to move said lifting member in a first direction along said arcuate path or a second direction along said arcuate path, substantially opposite to said first direction.

8. The reproduction apparatus according to claim 7 wherein said motor is a reversible motor.

9. The reproduction apparatus according to claim 8 wherein said lifting member is a rack, and wherein said operative coupling means includes a gear train connecting said output shaft of said motor to said rack.

10. The reproduction apparatus according to claim 7 wherein said control means includes limit switches, contacting said lifting member, adapted to be respectively actuated at the end of travel of said lifting member in said arcuate path.

* * * * *

UNITED STATES PATENT AND TRADEMARK OFFICE

CERTIFICATE OF CORRECTION

PATENT NO. : 5,581,332
DATED : December 3, 1996
INVENTOR(S) : Calvin A. Frelier et al

It is certified that an error appears in the above-identified patent and that said Letters Patent is hereby corrected as shown below:

Col 6, line 16, "lifting member" should read --rack--

Signed and Sealed this

Twenty-first Day of October 1997

*Attest:*

*Attesting Officer*

BRUCE LEHMAN

*Commissioner of Patents and Trademarks*